United States Patent [19]

Losenno

[11] 4,159,773

[45] Jul. 3, 1979

[54] BEAUTICIAN'S TOOL HANGER

[76] Inventor: Luigi G. Losenno, 4525 Drexel Ave. South, Edina, Minn. 55424

[21] Appl. No.: 712,933

[22] Filed: Aug. 9, 1976

[51] Int. Cl.[2] ..... A47F 7/00

[52] U.S. Cl. ..... 211/60 T; 211/89; 248/117.1; 248/224.3

[58] Field of Search ..... 211/60–69, 211/87, 89; 248/316 D, 108–113, 121, 117, 117.1, 224.3; 312/206, 207

[56] References Cited

U.S. PATENT DOCUMENTS

| | | | |
|---|---|---|---|
| 807,757 | 12/1905 | Martin | 211/87 |
| 975,246 | 11/1910 | Johnson | 211/96 X |
| 1,294,916 | 2/1919 | Knight | 211/87 X |
| 1,310,089 | 7/1919 | Rhodes | 312/206 |
| 2,021,496 | 11/1935 | Anger | 248/117.1 |
| 2,191,649 | 2/1940 | Gey | 248/117.1 |
| 2,269,940 | 1/1942 | Johnson | 211/65 X |
| 2,448,227 | 8/1948 | McCan | 248/117.1 |
| 2,707,052 | 4/1955 | Brown | 211/65 |
| 2,854,147 | 9/1958 | Derr | 211/60 R |
| 2,992,805 | 7/1961 | Weldon | 248/316 D |
| 3,343,684 | 9/1969 | Galier | 211/89 |

FOREIGN PATENT DOCUMENTS

| | | | |
|---|---|---|---|
| 98224 | 3/1906 | Canada. | |
| 110364 | 2/1908 | Canada. | |
| 463382 | 4/1951 | Italy | 248/113 |

*Primary Examiner*—Roy D. Frazier
*Assistant Examiner*—Robert W. Gibson, Jr.
*Attorney, Agent, or Firm*—Wicks & Nemer

[57] ABSTRACT

A beautician's tool hanger is disclosed, in the preferred form, as including a main frame arranged for supporting curling irons, a member for thermally insulating the main frame from a wall by spacing the main frame therefrom to thereby provide an air insulation barrier between a beautician's tool, for example a curling iron, and the wall, a tongue for insertion into a wall attachment member, and a hook used in attaching a further beautician's tool, for example, a hot comb, thereto all formed by a unitary, elongated, member being generally C-shaped. The main frame, in the preferred embodiment, includes an elongated arm member attached at approximately its midpoint, to the main frame, and pressure clip members, located at the outer ends of the arm member, for receiving the heated portion of the curling irons.

3 Claims, 3 Drawing Figures

BEAUTICIAN'S TOOL HANGER

BACKGROUND

This invention relates generally to a beautician's tool hanger and more specifically to a tool hanger for heated beautician's tools.

In the field of hair beautification styling, a need has arisen for tool hangers, especially curling iron and hot comb hangers. Previously, hot combs and curling irons were laid on a vanity or other surface where on numerous occasions the heated iron contacted the vanity and created a potential fire hazard. This posed a special problem if the operator accidentally forgot to unplug the curling iron at the completion of the working day such that the curling iron was left on over the evening hours or over the weekend. Therefore, a need has arisen for a tool hanger to thermally insulate heated tools, such as the curling iron, away from its support surface.

Further, a need has arisen for placing the curling iron, hot comb, and other accessories out of the way of the face, hands, and other bodily members of the operator and/or person having their hair done. Also, a need has arisen for allowing easy access to and use of the curling iron, hot comb, or accessories. Additionally, the electrical cords of the curling iron and/or hot comb should be in a position such that they are hanging out of the way.

SUMMARY

The apparatus of the present invention solves these and other problems in beautician's tool hangers by providing a main frame, a member for receiving a portion of the tools, for example a heated tool such as a curling iron, a member for attaching the receiving member to the main frame, a thermally insulating member, a wall attachment member, and a further tool holder, for example hot comb attaching member.

It is thus a primary object of the present invention to provide novel beautician's tool hanger apparatus.

It is further an object of the present invention to provide such novel hanger apparatus which thermally insulates heated beautician's tools from the support surface.

It is further an object of the present invention to provide such novel hanger apparatus which places the heated beautician's tools out of the way but within easy access of the operator.

These and further objects and advantages of the present invention will become clearer in the light of the following detailed description of an illustrative embodiment of this invention described in connection with the drawings.

DESCRIPTION OF THE DRAWINGS

The illustrative embodiment may best be described with reference to the accompanying drawings where.

Figures 1, 2, 3:
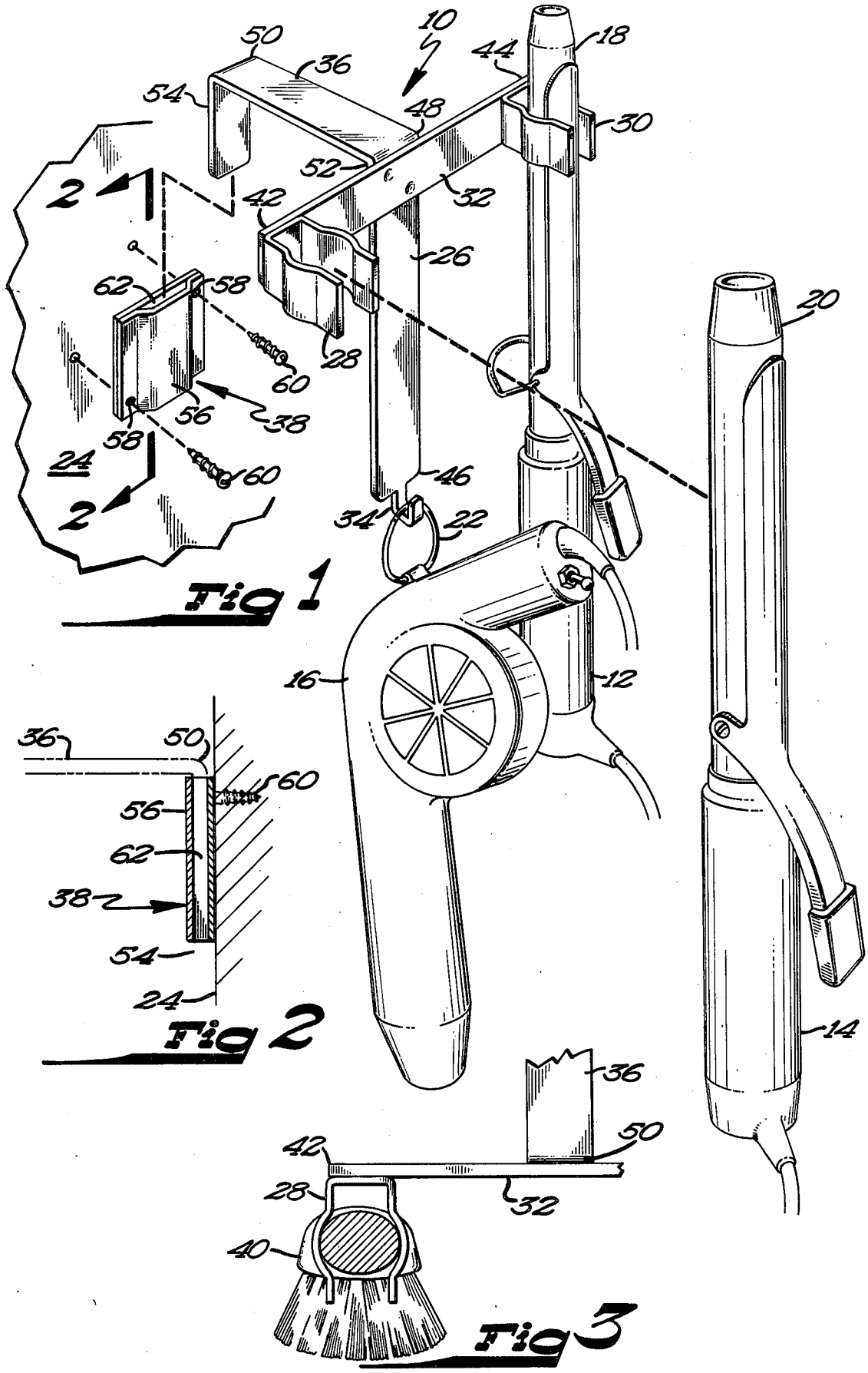
FIG. 1 shows an exploded view of a beautician's tool hanger according to the teachings of the present invention and supporting a hot comb and a curling iron.
FIG. 2 shows a cross-sectional view of the hanger of FIG. 1 according to Section Line 2—2 of FIG. 1.
FIG. 3 is a partial top view of the apparatus of FIG. 1 used for hanging a beautician's brush.

All figures are drawn for the ease of explanation of the basic teachings of the present invention only. Extensions of the figures with respect to number, position, relationship, and dimensions of the parts to form preferred embodiments will be explained or will be within the skill of the art after the following teachings of the present invention have been read and understood.

DESCRIPTION

In FIG. 1, a beauticians's tool hanger according to the teachings of the present invention is shown and generally designated 10 in use with a first curling iron 12, a second curling iron 14, and a hot comb 16. First and second curling irons 12 and 14 include heated portions 18 and 20, respectively. Hot comb 16 includes a ring member 22 whose purpose will be explained further hereinafter. Hanger 10 is shown attached to a vertical wall 24, as will be explained further hereinafter.

Hanger 10 includes a main frame 26, members 28 and 30 for receiving the heated portions 18 and 20 of curling irons 12 and 14, member 32 for attaching members 28 and 30 to main frame 26, member 34 for attaching hot comb 16 to main frame 26, member 36 for thermally insulating main frame 26 and curling irons 12 and 14 from wall 24, and member 38 for attaching member 36 to wall 24.

Main frame 26 is shown in its preferred form as an elongated, flat, bar-shaped member, preferrably formed of metallic material.

Members 28 and 30 are shown in their preferred form as spring pressure clips, and preferrably are formed of metallic material. It should be noted that members 28 and 30 can be of the same size such that they receive the same diameter heated portions 18 and 20 of curling irons 12 and 14 or can be of different sizes, as shown, such that different diameter heated portions 18 and 20 of curling irons 12 and 14 can be received such that the operator has different diameter curling irons within easy access. It should also be noted that members 28 and 30 can also be used for holding other beautician's tools, such as brush 40, as shown in FIG. 3.

Member 32 is shown in the preferred embodiment as an elongated, flat, bar-shaped member attached to main frame 26, and preferably formed of metallic material. In the preferred embodiment, member 32 is attached to main frame 26, such as by riveting, as shown, spot welding, or other, substantially near the midpoint of member 32 to thus form a T-shaped member. Members 28 and 30 are attached on opposite, outer ends 42 and 44 of member 32 such that members 28 and 30 are located on opposite sides of main frame 26.

It should be noted that although hanger 10 is shown including two curling iron receiving members 28 and 30, another number of such members can be provided according to the teachings of the present invention. For example, if more than two curling iron receiving members were provided, member 32 as shown could be extended to accommodate any such additional curling iron receiving members.

Member 34, in its preferred form, comprises a hook member formed on first end 46 of main frame 26 for receiving a portion of hot comb 16, specifically ring member 22 of hot comb 16 as shown in FIG. 1.

Member 36 is shown in its preferred embodiment, as a stand-off, extension bracket having a first end 48 and a second end 50. The first end 48 of member 36 is attached to second end 52 of main frame 26. In its preferred form, member 36 is formed of an elongated, flat, bar-shaped member of metallic material. Member 36 thermally insulates main frame 26 and curling irons 12 and 14 located within members 28 and 30 from wall 24 by spacing main frame 26 and curling irons 12 and 14 from wall 24 to thus provide an air insulation barrier therebetween. Therefore, curling irons 12 and 14 are held in a spaced, thermally insulated position away from each other and away from wall 24 to thus prevent curling irons 12 and 14 from burning wall 24.

Member 38 is shown in its preferred embodiment in FIGS. 1 and 2, as a member for removably attaching member 36 to wall 24. Specifically, member 38 is shown in its preferred form as including tongue 54 attached to second end 50 of member 36, and a wall attachment member 56 including members 58, shown as apertures, passing through member 56 for receiving screws 60 for attachment to wall 24 and a slot member 62 for removably receiving tongue 54. In the preferred embodiment, member 38 is also formed of metallic material.

It should be noted that tongue 54, member 36, main frame 26, and member 34 are formed in a preferred embodiment from a unitary, elongated member having a generally C-shape thus lending itself to mass production techniques. Therefore, hanger 10 can be easily fabricated at a low cost in material and labor.

OPERATION

In installing hanger 10, tongue 54 is removed form slot 62 of member 38. At that time, member 56 can be positioned at the desired location on wall 24 such that screws 60 can be inserted through members 58 and attached into wall 24.

Tongue 50 can then be placed in slot member 62 and curling irons 12 and 14 and hot comb 16 can be positioned on hanger 10, as generally shown in the figures.

It can then be noted that curling irons 12 and 14 and hot comb 16 are within easy access of the operator and can be easily removed from hanger 10. Further curling irons 12 and 14 and hot comb 16 are out of the way of the operator when not in use. Additionally, the electric cords of the curling irons 12 and 14 and hot comb 16 are also not in the way.

Further, hanger 10 allows the heated portion of curling irons 12 and 14 to be thermally insulated from the support surface to thus prevent burns or other fire hazards therefrom. Specifically, curling irons 12 and 14 are held in a spaced relation to wall 24 by member 36 of hanger 10 to thus provide a thermal, air insulation barrier therebetween. Additionally, if the electricity was accidentally not disconnected at the end of the working day, the heating portions are harmlessly located away from any surface and therefore the danger of fire hazard, that existed prior to the present invention, is substantially removed.

Now that the basic teachings of the present invention have been explained, many extensions and variations will be obvious to one having ordinary skill in the art. It should be noted that although tongue 54, member 36, main frame 26, and member 34 are formed in the preferred embodiment from a unitary, elongated member, other forms and shapes thereof can be utilized according to the present invention. For example, first end 48 of member 36 could be attached to approximately the midpoint or other location of main frame 26 rather than to the second end 52 of main frame 26.

It should further be noted that although in the preferred embodiment, members 28 and 30 are shown receiving the heated portions of the curling irons, other portions of the curling iron can be attached thereby.

Thus, since the invention disclosed herein may be embodied in other specific forms without departing from the spirit or the general characteristics thereof, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Beautician's tool hanger for attachment of a beautician's tool having a heated portion, a curling iron having a heated portion, and another beautician's tool to a vertical wall, comprising, in combination: an elongated, flat bar-shaped main frame; an elongated, flat, bar-shaped arm having at least one vertical face, with the arm attached substantially perpendicularly to the main frame with the vertical face oriented outwardly toward an operator and away from the main frame to thus form a T-shaped member; a first pressure clip for receiving the heated portion of the beautician's tool; a second pressure clip for receiving the heated portion of the curling iron; with the first and second pressure clips being vertically attached adjacent the opposite ends of the arm and on the vertical face of the arm so that the beautician's tool and the curling iron hang vertically down therefrom; a hook formed adjacent an end of the main frame for receiving a portion of and for attaching the other beautician's tool to the main frame; a stand-off, extension bracket attached to the main frame for spacing the main frame, the arm, and the hook from the wall and for thermally insulating the main frame and the beautician's tool and the curling iron, located in the first and second pressure clips, from the wall by spacing the main frame and the beautician's tool and the curling iron from the wall to thus provide an air insulation barrier therebetween; and means for attaching the stand-off extension bracket to the wall, wherein at least the beautician's tool and the curling iron are held in a spaced, thermally insulated position away from the wall to thus prevent the beautician's tool and the curling iron from burning the wall and also allowing the beautician's tool, the curling iron, and the other beautician's tool to be easily accessible to the operator and out of the way of the operator when not in use.

2. The hanger of claim 1 wherein the wall attaching means includes a tongue formed on the stand-off extension bracket; and a slot member for removably receiving the tonque.

3. The hanger of claim 1 wherein the wall attaching means comprises, in combination: a tongue formed on the stand-off extension bracket; and a wall attachment member including means passing through the wall attaching member for receiving screws for insertion into the wall and including a slot member for removably receiving the tongue, and wherein the tongue, the stand-off extension bracket, the main frame, and the hook member are formed from a unitary, elongated member having a generally C-shape.

* * * * *